US005878740A

United States Patent [19]

Videto et al.

[11] Patent Number: 5,878,740

[45] Date of Patent: Mar. 9, 1999

[54] NOISE REDUCING DEVICE FOR COMBUSTION DRIVEN HEATING APPARATUS

[75] Inventors: Brian D. Videto, Syracuse; Mark A. Daniels, Manlius; Robert H. Swieczkowski, Cazenovia, all of N.Y.

[73] Assignee: Carrier Corporation, Syracuse, N.Y.

[21] Appl. No.: 738,559

[22] Filed: Oct. 28, 1996

[51] Int. Cl.[6] ..... F24C 3/00

[52] U.S. Cl. ..... 126/91 A; 431/114

[58] Field of Search ..... 126/91 A, 116 R, 126/110 R; 431/114, 347

[56] References Cited

U.S. PATENT DOCUMENTS

| | | | |
|---|---|---|---|
| 2,394,627 | 2/1946 | McCollum et al. | 431/114 |
| 3,324,845 | 6/1967 | White | 126/116 R |
| 4,869,230 | 9/1989 | Fletcher et al. | 431/114 |
| 4,923,033 | 5/1990 | Panick et al. | 126/116 R |
| 5,215,454 | 6/1993 | Ferramola et al. | 431/114 |

*Primary Examiner*—James C. Yeung

[57] ABSTRACT

An apparatus for reducing the resonant type noise generated in a combustion driven heating apparatus. A dissipative device is disposed within a hot gas passageway to absorb and attenuate acoustic wave energy and thereby reducing the resonant noise level of the heating apparatus.

5 Claims, 1 Drawing Sheet

NOISE REDUCING DEVICE FOR COMBUSTION DRIVEN HEATING APPARATUS

TECHNICAL FIELD

This invention relates generally to noise reduction and more specifically to reducing resonance type noise emissions in fuel fired heat exchangers and furnaces.

BACKGROUND ART

Combustion driven heating apparatus contain certain combinations of burners, combustion chambers heat exchangers and furnace stacks which result in resonance events that produce excessive noise levels. The natural frequency for an air column, as is present in heat exchangers and furnace stacks, is described by $v=c/2L$, where c is the average speed of sound in the flue gas and L is the total length of the air column. For reasons that are not completely understood, the combustion process will occasionally oscillate in phase with this frequency. This oscillation produces a standing acoustic wave inside of the heat exchanger or furnace stack in the same manner as a standing wave exists in an organ pipe. The standing acoustic wave produces harmonics in the frequency range of 50 Hertz to 300 Hertz. Intense tones in this frequency range are produced and are very difficult to treat without affecting the performance of the heating apparatus.

Combustion driven heating apparatus also produce other types of objectionable noise. One of these types of noise, known as screeching, is relevant to high velocity power burners where the sound produced is caused by frictional flow due to high rates of gas flows within the burner. This type of noise may be reduced, and sometimes eliminated, by treating it at or near the burner itself. For example U.S. Pat. No. 2,154,133 discloses a method of attenuating the noise downstream of the burner with ducting treated with acoustic insulation. In U.S. Pat. No. 3,684,424 there is disclosed a method of enclosing the burner in a housing treated with acoustic insulation to attenuate the screeching type noise. While in U.S. Pat. No. 5,017,129 there is disclosed a method of mixing two streams of air at the burner to reduce the overall frictional effects that produce the screeching noise. While these burners reduce or eliminate the frictional flow form of noise they do little to reduce the resonance form of noise produced by gas fired heating apparatus.

Another type of noise generated by combustion driven heating apparatus is broadband in nature and is a result of fluctuating density in the flame emanating from the burner itself. It is known in the industry to treat this type of noise by suppressing or eliminating through the use of acoustic insulation as disclosed in U.S. Pat. No. 4,029,462. U.S. Pat. No. 4,175,919 discloses a method of attenuating this type of noise by providing a first burner with a laminar flow and a second burner having a turbulent flow. In U.S. Pat. No. 5,344,308 a method is disclosed to treat this type of noise by providing a number of holes in the combustion chamber downstream of the burner to allow combustion type noise to escape from the combustion chamber. These inventions are also focused on reducing or eliminating noise from a specific source and therefor do little to reduce the resonance form of noise produced by a combustion driven heating apparatus. It should also be noted that the reduction or elimination of noise in the higher frequency ranges, above 300 Hertz, is somewhat easier than the reduction or elimination of resonant type noise which tends to be in the lower frequency range.

Resonant type noise in combustion driven heating apparatus has been dealt with in a variety of ways and to various degrees of success by others in the field. For instance U.S. Pat. No. 5,525,056 discloses a method of isolating the burner from the fuel supply by use of slots and acoustic baffles in the combustion chamber. These features are intended to prevent the burner from oscillating in phase with the combustion chamber. Likewise U.S. Pat. No. 4,090,558 discloses a method of treating resonance type noise at the burner itself by utilizing a separate heat exchanger having a circuitous flow path and passive resonators within the burner assembly to absorb objectionable noise. In yet another example, U.S. Pat. No. 5,435,716 treats the noise problem within the combustion chamber. In the '716 patent a method of absorbing acoustic energy is disclosed wherein a flexible membrane is installed in the combustion chamber wall. The membrane expands and contracts in response to pressure fluctuations within the combustion chamber, thereby absorbing acoustic energy.

DISCLOSURE OF INVENTION

In general it is an object of the present invention to provide for the treatment of the acoustic wave in a combustion driven heating apparatus with an energy dissipating material. In accordance with the present invention, a dissipative device is inserted into the tubes of the heat exchanger down stream of the burner and combustion chamber to absorb and attenuate acoustic wave energy. The dissipative device may advantageously be a self supporting, open cell, reticulated structure. The invention significantly reduces resonance type noise emissions.

BEST MODE FOR CARRYING OUT THE INVENTION

As will be described in detail below the present invention is set forth in terms of providing for the treatment of acoustic energy by use of a dissipation device in the tubes of a combustion driven heating apparatus having a heat exchanger. However, it should be evident to those skilled in the art that the present invention is not limited to this specific example and could be used with a number of applications where standing acoustic wave energy produces organ tones.

Figure 1:
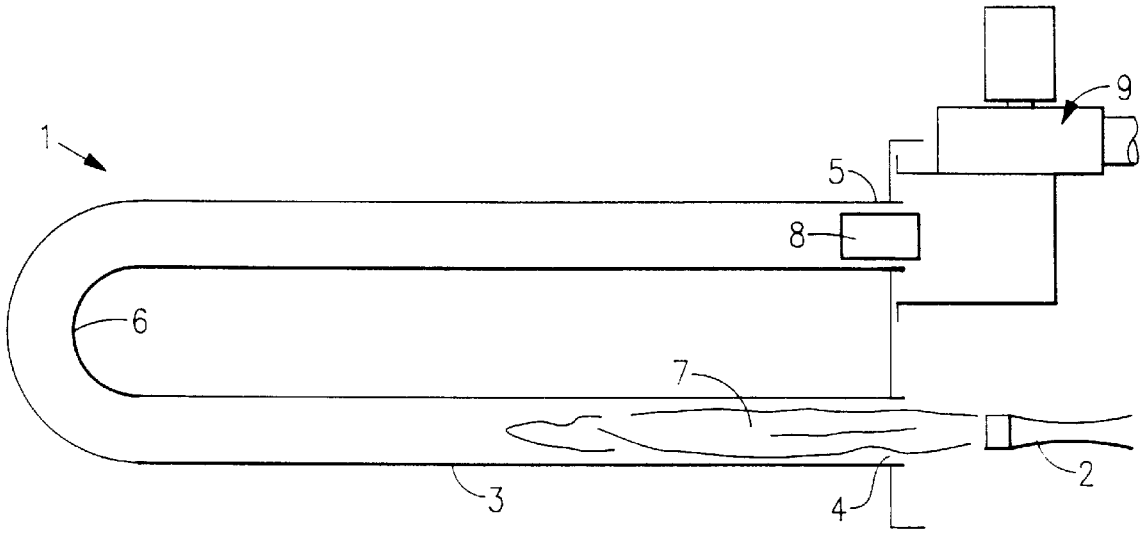
FIG. 1 is a side view of a heat exchanger incorporating the dissipative device of the present invention.

FIG. 1 illustrates a combustion driven heating apparatus 1 of the type commonly used in roof top air conditioning units. The heat exchanger includes one or more flow circuit tubes for carrying heated gases from the burners. For the purposes of explanation, combustion driven heating apparatus is comprised of a gas fired burner 2, and at least one tube 3. The tube 3 defines a hot gas flow passageway having an inlet 4 and an outlet 5 and connected by a 90 bend 6. It should be evident, however, that more circuits, as well as more passes, may be added to the unit depending upon the demands of the system. The gas burner 2 produces a flame 7 that is introduced into the hot gas flow passageway of the tube 3 at inlet 4. The hot gas flow passageway exhausts into an inducer 9. The energy imparted to the heat exchanger by the burner, given certain physical characteristics of the heat exchanger, sometimes causes the combustion process to oscillate in phase with the natural frequency of the hot gas flow passageway of the tube 3. This oscillation produces a standing acoustic wave inside the hot gas flow passageway of the tube 3 and which in turn produces harmonics having intense tones that are objectionable to humans.

The objective of the present invention is to dissipate the energy associated with the standing acoustic wave and thereby reduce the resonance type noise emission of the heat exchanger. It is preferable to dissipate the energy in the system at the point at which the acoustic velocity is at a maximum. By inserting a dissipative device at an acoustic velocity maximum, sufficient energy is removed to eliminate the standing wave. Referring to FIG. 1, it is an important aspect of the present invention to understand that the velocity wave has a node (zero velocity amplitude) at x=L/2, and anti-nodes (maximum velocity amplitude) at both x=0 and at x=L, that is at the inlet 4 and the outlet 5 of the hot gas flow passageway defined within the tube 3. It should be noted that the harmonics that are produced by the standing acoustic wave will, although higher in frequency, will maintain maximum velocities at x=0 and x=L. Since the two ends are acoustically identical, the present invention would be equally effective at either tube end.

The preferred embodiment of the present invention comprises the placement of the dissipative device 8 at the location x=L, i.e. at the outlet 5. It is also preferable that the dissipative device 8 substantially fill the cross sectional area of the tube 3. If excessive voids are present, then the acoustic wave will be transmitted with little attenuation. The configuration of the preferred dissipative device is chosen to handle the temperatures within the tube, absorb enough energy to attenuate the acoustic wave, and be porous enough to cause as little pressure drop in the tube as possible. The placement of the dissipative device at the outlet 5 of the hot gas flow passageway defined within the tube 3 allows for maximum attenuation because the acoustic velocity is always at a maximum, and also allows for the use of different materials because of the lower temperatures relative to the higher gas temperature at the inlet 4 through which the hot gases generated by the burner 2 enter the gas flow passageway defined by the tube 3.

Another embodiment of the present invention involves the placement of the dissipative device at the inlet of the inducer in a combustion driven heating apparatus. The placement of the device at this location permits the use of a single device in a system having multiple hot gas flow passageways while maintaining the ability to reduce the resonant type noise produced in the system.

The preferred dissipative device 8 of the present invention, as depicted in FIG. 1, is an insert commonly used as a filter and is manufactured from a reticulated silicon carbide foam by Selee Corporation. This particular composition is disclosed in U.S. Pat. No. 5,039,340, among others, and the entire disclosure of U.S. Pat. No. 5,039,340 is hereby incorporated by reference.

Figure 2:
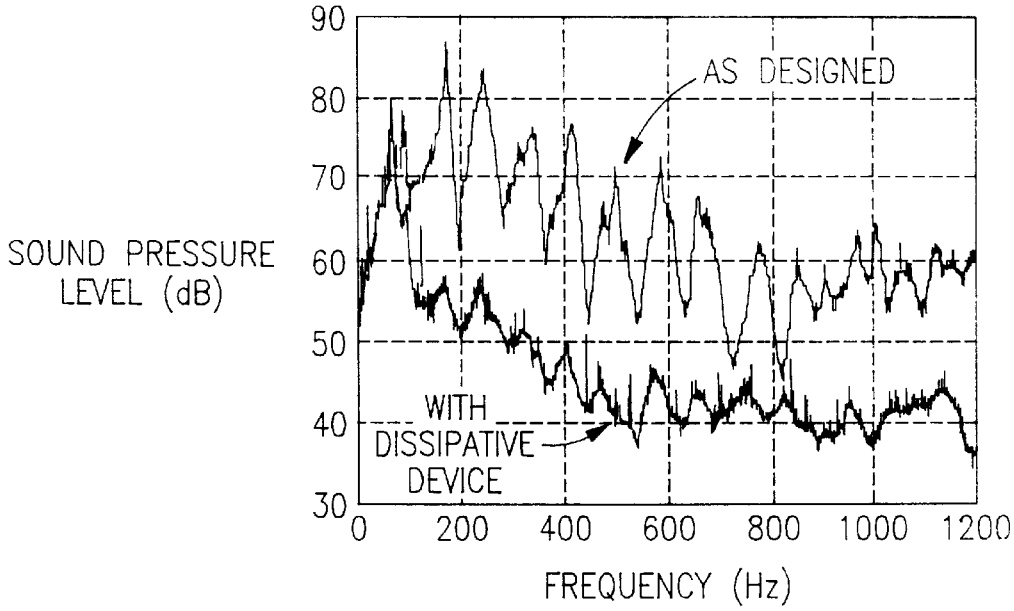
FIG. 2 is a graph showing the sound attenuating effects of one embodiment of the present invention.

Dissipative devices of varying lengths and porosity have been tested for their effectiveness at reducing resonant type noise as well as their associated pressure drop. Considerable testing was done with a device having a diameter of 2.1 inches, a length of 2.0 inches and a porosity of 25 pores per inch. The device was inserted into a heat exchanger tube of a gas fired system having a gas input of 43,500 BTU per hour, a mass flow rate of 65 pounds per hour and a flue temperature of 420° Fahrenheit. The pressure drop for this configuration has is approximately 1.15 inch $H_2O$. Referring to FIG. 2, the peak noise level decreases from 87 dB (at 170 Hz) in the untreated case to 57 dB when treated with the dissipative device.

What is claimed is:

1. A combustion driven heating apparatus with resonance type noise suppression, comprising at least one flow circuit tube having an inlet end and an outlet end and defining a gas flow passageway extending from the inlet end to the outlet end, and an energy dissipative self supporting open cell structure having a plurality of interconnected voids for suppressing resonance type noise, wherein the structure is disposed within and substantially fills and extends across the cross sectional area of the gas flow passageway defined within the flow circuit tube such that substantially all of said gas in said passageway flows through said structure.

2. The apparatus according to claim 1, wherein the structure is disposed at the outlet end of the gas flow passageway.

3. The apparatus according to claim 1, further comprising an inducer disposed at the outlet end of the flow circuit tube further defining the gas flow passageway, wherein the structure is disposed within the inducer while substantially extending across the cross sectional area of the gas flow passageway.

4. The apparatus according to claim 1, wherein the structure is comprised of a ceramic foam material.

5. The apparatus according to claim 1, wherein the structure is comprised of a metallic foam material.

* * * * *